US008459634B2

(12) United States Patent
Asari et al.

(10) Patent No.: US 8,459,634 B2
(45) Date of Patent: Jun. 11, 2013

(54) PAPER SHEET PICKUP DEVICE

(75) Inventors: Yukio Asari, Yokohama (JP); Yusuke Mitsuya, Yokohama (JP); Yoshihiko Naruoka, Yokohama (JP); Toru Todoriki, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 13/270,827

(22) Filed: Oct. 11, 2011

(65) Prior Publication Data

US 2012/0025448 A1 Feb. 2, 2012

Related U.S. Application Data

(62) Division of application No. 12/544,368, filed on Aug. 20, 2009, now Pat. No. 8,096,546.

(30) Foreign Application Priority Data

Apr. 23, 2009 (JP) ..... 2009-105267

(51) Int. Cl.
*B65H 3/12* (2006.01)

(52) U.S. Cl.
USPC ..... 271/96

(58) Field of Classification Search
USPC ..... 271/96
See application file for complete search history.

(56) References Cited

U.S. PATENT DOCUMENTS

| | | | | |
|---|---|---|---|---|
| 3,595,563 | A * | 7/1971 | Rostoker et al. | 271/96 |
| 4,299,381 | A * | 11/1981 | Smith | 271/96 |
| 4,662,622 | A * | 5/1987 | Wimmer et al. | 271/96 |
| 5,076,564 | A * | 12/1991 | Marass | 271/11 |
| 5,154,407 | A * | 10/1992 | Shidara | 271/12 |
| 5,356,127 | A * | 10/1994 | Moore et al. | 271/11 |
| 5,391,051 | A | 2/1995 | Sabatier et al. | |
| 5,478,066 | A * | 12/1995 | Yoshida et al. | 271/12 |
| 5,988,626 | A * | 11/1999 | La Vos et al. | 271/96 |
| 6,186,491 | B1 * | 2/2001 | Tomiyama et al. | 271/12 |
| 6,575,450 | B2 * | 6/2003 | Blackwell et al. | 271/11 |
| 6,918,581 | B2 * | 7/2005 | Horiuchi | 271/96 |
| 7,059,595 | B2 * | 6/2006 | DaCunha et al. | 271/96 |
| 7,845,629 | B2 * | 12/2010 | Mitsuya et al. | 271/11 |
| 7,954,805 | B2 | 6/2011 | Mitsuya et al. | |
| 2002/0101022 | A1 | 8/2002 | Blackwell et al. | |
| 2010/0207315 | A1 | 8/2010 | Todoriki | |

FOREIGN PATENT DOCUMENTS

| | | |
|---|---|---|
| EP | 2 221 263 A2 | 8/2010 |
| JP | 59-146337 U | 9/1984 |
| JP | 64-38276 U | 3/1989 |

(Continued)

OTHER PUBLICATIONS

Japanese Office Action dated Jan. 8, 2013.

(Continued)

*Primary Examiner* — Prasad Gokhale
(74) *Attorney, Agent, or Firm* — Pillsbury Winthrop Shaw Pittman, LLP

(57) ABSTRACT

A paper sheet pickup device includes a pickup belt configured to run along one of accumulated paper sheets, which is positioned at the most downstream side with respect to a direction of accumulation, and a negative pressure chamber provided inside the pickup belt. The negative pressure chamber is connected to a pump, and a valve unit is interposed therebetween. Further, an air inlet tube is connected to the negative pressure chamber for supplying air therein.

6 Claims, 13 Drawing Sheets

FOREIGN PATENT DOCUMENTS

| | | |
|---|---|---|
| JP | 1-106446 U | 7/1989 |
| JP | 2000-109229 | 4/2000 |
| JP | 2001-080768 | 3/2001 |
| JP | 2005-132618 | 5/2005 |

OTHER PUBLICATIONS

European Search Report dated Feb. 18, 2013.

* cited by examiner

PAPER SHEET PICKUP DEVICE

CROSS-REFERENCE TO RELATED APPLICATIONS

This application is a divisional of U.S. application Ser. No. 12/544,368, filed Aug. 20, 2009 now U.S. Pat. No. 8,096,546, and for which priority is claimed under 35 U.S.C. §121. This application is based upon and claims the benefit of priority under 35 U.S.C. §119 from the prior Japanese Patent Application No. 2009-105267, filed Apr. 23, 2009, the entire contents of all applications are incorporated herein by reference in their entireties.

BACKGROUND OF THE INVENTION

1. Field of the Invention

The present invention relates to a paper sheet pickup device for picking up a plurality of accumulated paper sheets one by one.

2. Description of the Related Art

A paper sheet pickup device is known, in which a belt with holes is run along paper sheets to hold them on the belt using a suction force applied thereto through a suction nozzle provided at the reverse side of the belt, thereby picking up them one by one (see, for example, U.S. Pat. No. 5,391,051). In this device, a solenoid valve is provided between the suction nozzle and a vacuum tank.

In this structure, when picking up paper sheets, the belt is run, the solenoid valve is opened, and the suction nozzle is operated to hold each paper sheet on the belt using a suction force. Further, when continuously feeding paper sheets, the solenoid valve is closed regularly in accordance with the feeding timing of each paper sheet, thereby providing gaps between sequentially fed paper sheets.

However, in the above structure, even if the solenoid valve is closed to stop suction by the suction nozzle, the negative pressure exerted on a paper sheet cannot quickly be eliminated where the paper sheet is held by the belt. Accordingly, even if the on-off cycle of the solenoid valve is shortened to feed paper sheets at high speed, high-speed feeding of paper sheets cannot be realized since the negative pressure exerted on the paper sheets cannot quickly be eliminated. This being so, paper sheets cannot quickly be picked up with certain gaps provided between them. Further, when the negative pressure cannot instantly be eliminated, simultaneous pickup of two stacked paper sheets will easily occur.

FIGS. 18 and 19 are schematic views of a conventional solenoid valve 100. FIG. 18 shows a state in which the solenoid valve 100 is open, and FIG. 19 shows a state in which the solenoid valve 100 is closed.

In general, the solenoid valve 100 comprises a coil 104 for axially moving a substantially cylindrical plunger 102, a chamber 106 (only shown in FIG. 18) containing the plunger 102, and two holes 108*a* and 109*a* formed in the bottom of the chamber 106 through which two tubes 108 and 109 are connected to the chamber. If the solenoid valve 100 is used in the above-mentioned apparatus of U.S. Pat. No. 5,391,051, the suction nozzle and the vacuum tank are connected to the two tubes 108 and 109, respectively.

When opening the solenoid valve 100, current is supplied to the coil 104 to pull the plunger 102 out of the chamber 106 and cause the two holes 108*a* and 109*a* to communicate with each other via the chamber 106. In contrast, when closing the solenoid valve 100, the supply of current to the coil 104 is stopped to push the plunger 102 into the chamber 106 and bring the bottom of the plunger 102 into contact with the bottom of the chamber 106. As a result, the two holes 108*a* and 109*a* are blocked, and a fluid channel 110 connecting the two tubes 108 and 109 is blocked.

The solenoid valve 100, however, has great inertia since it is opened and closed by axially moving the plunger 102. If the diameter of the tubes 108 and 109 is increased to increase the amount of introduced air, it is necessary to increase the diameter of the plunger 102 for blocking the holes 108*a* and 109*a*, and hence the solenoid valve 100 will have still greater inertia.

Further, when the solenoid valve 100 is opened, much time is required until air flows into the chamber 106 to make the pressure therein reach a preset value, after the coil 104 is energized to move the plunger 102. Namely, the response of the solenoid valve 100 is slow until air starts to circulate after power is supplied. In contrast, when the solenoid valve 100 is closed, the plunger 102 moves slowly since it is pushed into the chamber 106 against the preset pressure therein. Namely, the conventional solenoid valve 100 slowly operates when the coil 104 is energized and de-energized.

Therefore, if the solenoid valve 100 is used between the suction nozzle and the vacuum tank as in the mail feeding apparatus disclosed in U.S. Pat. No. 5,391,051, high-speed pickup of paper sheets cannot be realized because of the previously mentioned problem concerning elimination of negative pressure, and also because of the slow response of the solenoid valve 100 itself.

In addition, if the solenoid valve 100 is used in the mail feeding apparatus of U.S. Pat. No. 5,391,051, it is difficult to hold a relatively large and heavy paper sheet on the belt with holes, using vacuum pressure introduced through the holes. To be more specific, when the solenoid valve 100 is open, it is necessary to circulate air through a channel bent at several positions as shown in FIG. 18, which causes high passing resistance and hence makes it difficult to increase the flow of the air. This means that it is difficult to draw a relatively large amount of air through the suction nozzle, and therefore to hold a heavy paper sheet using vacuum pressure.

BRIEF SUMMARY OF THE INVENTION

It is an object of the invention to provide a paper sheet pickup device that can easily pick up relatively heavy paper sheets, and can pick up paper sheets at high speed.

To attain the object, there is provided a paper sheet pickup device comprising: a pickup member configured to run along one of accumulated paper sheets, the one paper sheet being positioned at a most downstream side with respect to a direction of accumulation; a negative pressure chamber provided on a reverse side of the pickup member; a vacuum unit configured to draw air from the negative pressure chamber; a first opening/closing valve configured to open/close an air passage provided between the negative pressure chamber and the vacuum unit; an air inlet tube configured to introduce air into the negative pressure chamber; a second opening/closing valve configured to open/close an air passage provided between the negative pressure chamber and the air inlet tube; and a controller configured to open the first opening/closing unit after closing the second opening/closing unit, when opening the first opening/closing unit, and also configured to open the second opening/closing unit after closing the first opening/closing unit, when opening the second opening/closing unit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the invention will now be described in detail with reference to the accompanying drawings.

Figure 1:
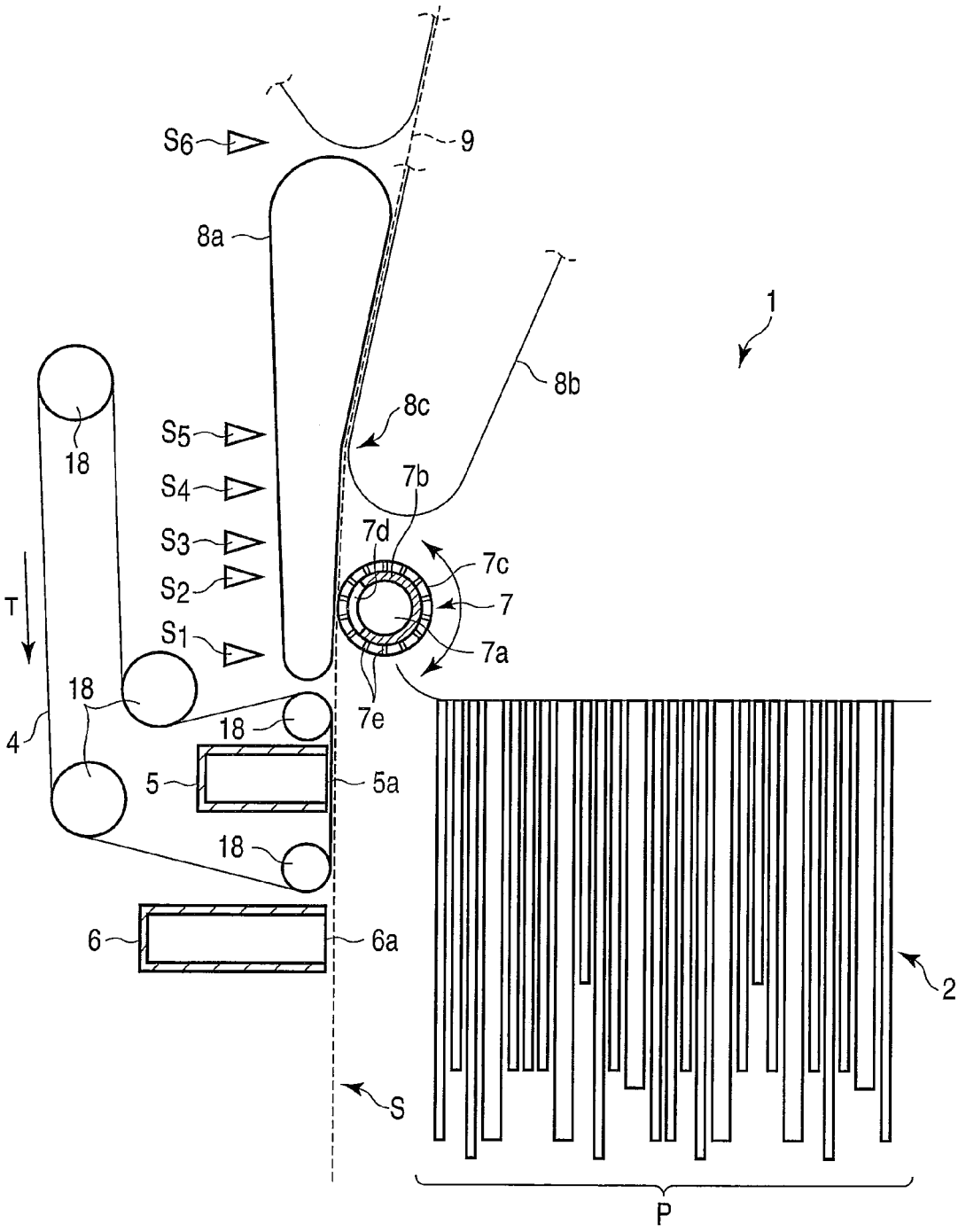
FIG. 1 is a schematic plan view, taken from above, of a paper sheet pickup device according to embodiments of the invention.
Figure 2:
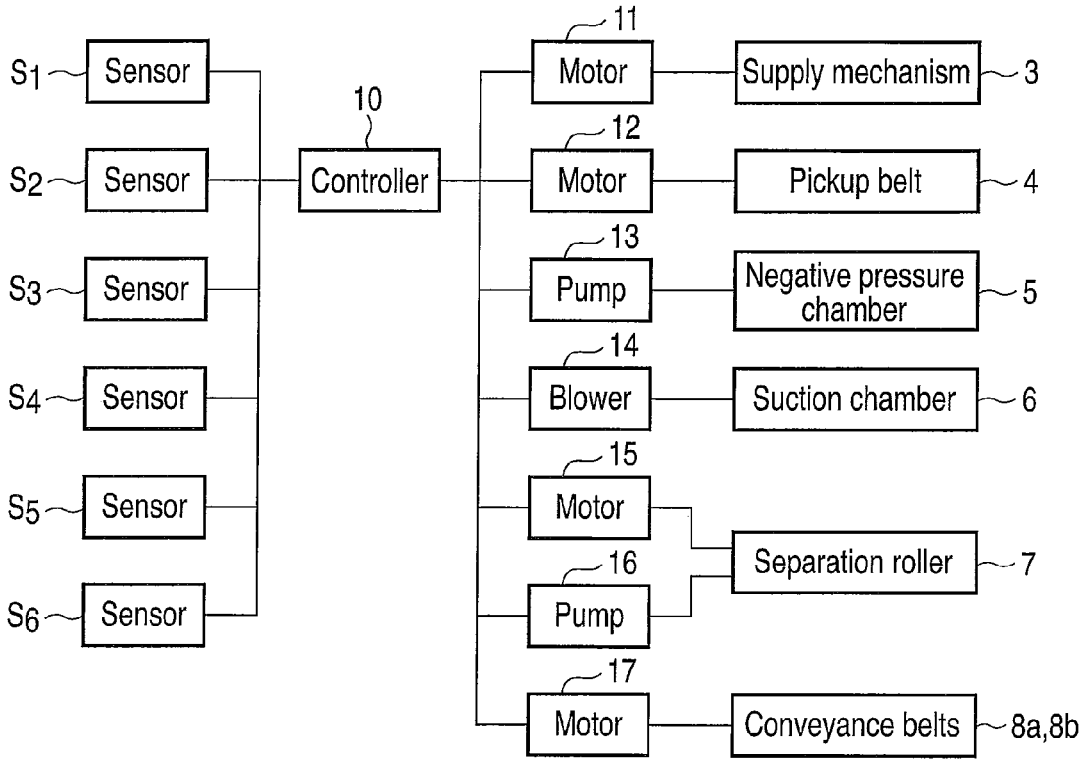
FIG. 2 is a block diagram illustrating a control system for controlling the operation of the pickup device of FIG. 1.

FIG. 1 is a schematic plan view taken from above and illustrating a paper sheet pickup device 1 (hereinafter, "pickup device 1") according to the embodiments of the invention. FIG. 2 is a block diagram illustrating a control system for controlling the operation of the pickup device 1.

The pickup device 1 comprises an inlet unit 2, a supply mechanism 3, a pickup belt 4 (pickup member), a negative pressure chamber 5, a suction chamber 6, a separation roller 7, conveyance belts 8*a* and 8*b*, sensors S1 to S6, and a controller 10 for controlling the operation of the entire pickup device.

The controller 10 is connected to the sensors S1 to S6, a motor 11 for driving a floor belt and a backup belt (not shown) incorporated in the supply mechanism 3, a motor 12 for running the pickup belt 4 in the direction indicated by arrow T, a pump 13 (vacuum unit) for drawing air from the negative pressure chamber 5, a blower 14 for drawing air from the suction chamber 6, a motor 15 for imparting separation torque to the separation roller 7, a pump 16 for causing a negative pressure to occur around the separation roller 7, and a motor 17 for running conveyance belts 8*a* and 8*b*.

The inlet unit 2 receives a plurality of paper sheets P in an accumulated and upright state. The paper sheets P received in the inlet unit 2 are moved to one side of the unit 2 (leftward in FIG. 1) and then to a pickup position S one by one by the supply mechanism 3. Whenever a paper sheet P supplied to the pickup position S is picked up, the supply mechanism 3 operates to guide, to the pickup position S, a subsequent one of the paper sheets P accumulated at the one side of the unit 2.

The pickup belt 4 is wound on a plurality of pulleys 18 and made to run endlessly. Part of the pickup belt 4 is brought into contact with each paper sheet P guided to the pickup position S, and made to run at a constant rate in a direction parallel to the surface of each paper sheet P, i.e., in the pickup direction T (upward in FIG. 1). The negative pressure chamber 5 is provided inside the pickup belt 4, opposing the pickup position S with the pickup belt 4 interposed therebetween.

Figure 3:
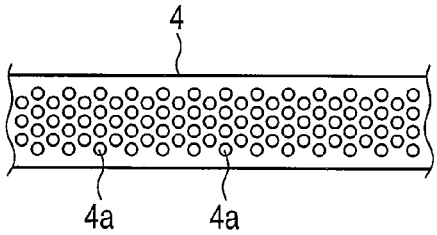
FIG. 3 is a schematic enlarged view illustrating a part of a pickup belt incorporated in the pickup device of FIG. 1.

As shown in FIG. 3, the pickup belt 4 has a plurality of suction holes 4*a* formed therein. The negative pressure chamber 5 has an opening 5*a* opposing the reverse side of the pickup belt 4. With this structure, when the pickup belt 4 is run and air is drawn from the negative pressure chamber 5, a negative pressure is applied to a paper sheet P positioned at the pickup position S through the opening 5*a* of the negative pressure chamber 5 and the suction holes 4*a* of the pickup belt 4, thereby holding the paper sheet P on the pickup belt 4 by the negative pressure. Thus, the paper sheet P held by the pickup belt 4 is picked up from the pickup position S during the running of the pickup belt 4.

Each paper sheet P picked up from the pickup position S is conveyed upward in FIG. 1 via a conveyance path 9, and transferred to the conveyance section 8. The sensors S1 to S6 provided along the conveyance path 9 are transmissive optical sensors (only one of the components of each sensor is shown). These sensors detect whether each paper sheet P crosses their optical axes (when it crosses their optical axes, they output a signal indicating "darkness"), and detect whether each paper sheet P does not exist on the optical axes (when it does not exist on their optical axes, they output a signal indicating "brightness"). Namely, the sensors S1 to S6 detect the leading and rear ends of each paper sheet P with respect to the direction of conveyance.

The suction chamber 6 is provided upstream (at the lower position in FIG. 1) of the pickup belt 4 with respect to the direction in which each paper sheet P is picked up, and has an opening 6*a* opposing the pickup position S. When the blower 14 is operated, air is drawn through the opening 6*a* of the suction chamber 6, thereby causing an air flow at the pickup position S. The air flow functions to quickly draw each paper sheet P received in the inlet unit 2 and fed to the above-mentioned one side of the inlet unit 2 (the most downstream side of the inlet unit 2 with respect to the direction of accumulation).

The separation roller 7 is provided downstream of the pickup position S with respect to the paper sheet pickup direction, and opposes the pickup belt 4 with the conveyance path 9 interposed therebetween. The separation roller 7 includes a substantially cylindrical core 7*b* with a chamber 7*a* defined therein, and a substantially cylindrical sleeve 7*c* rotatably provided on the outer periphery of the core 7*b*. The core 7*b* has an opening 7*d* fixedly opening to the conveyance path 9. The sleeve 9*c* has a plurality of suction holes 7*e*. With this structure, when the pump 16 is operated to draw air from the chamber 7*a* of the core 7*b*, a negative pressure occurs at the periphery of the separation roller 7 via the suction holes 7*e* of the sleeve 7*c* that rotates around the core 7*b*.

Namely, by applying, to the sleeve 7*c*, separation torque that exerts in a direction opposite to the paper sheet pickup direction, using the motor 15, and causing a negative pressure around the outer periphery of the sleeve 7*c*, using the pump 16, a few paper sheets P picked up unintentionally simultaneously with a leading paper sheet P when the leading paper sheet is picked up from the pickup position S can be separated from the leading paper sheet.

The conveyance belt 8*a*, an endless belt, is tensioned (at the left side in FIG. 1), opposing the separation roller 7 with the conveyance path 9 interposed therebetween. Further, the conveyance belt 8*b*, an endless belt, is tensioned, opposing the conveyance belt 8*a* with the conveyance path 9 interposed therebetween. Thus, the conveyance path 9 located downstream of the separation roller 7 is defined between the two conveyance belts 8*a* and 8*b*. The front end of each paper sheet P picked up from the pickup position S is nipped by the nip 8*c* of the conveyance belts 8*a* and 8*b*, and conveyed to the downstream side by the conveyance belts 8*a* and 8*b* (conveyance section).

A description will now be given of the operation of feeding, one by one onto the conveyance path 9, a plurality of paper sheets P received in the inlet unit 2.

When a plurality of paper sheets P are fed from the inlet unit 2 to the pickup device 1, they are sequentially supplied by the supply mechanism 3 to the pickup position S, and are drawn by the pickup belt 4 and fed onto the conveyance path 9. The paper sheets P conveyed through the conveyance path 9 are monitored in conveyance position and state by the controller 10 via the sensors S1 to S6.

When each paper sheet P is picked up, the pump 13 is operated to draw air from the negative pressure chamber 5, thereby generating a negative pressure on the surface of the pickup belt 4. Further, an air flow directed to the pickup position S is constantly applied by the suction chamber 6 to the paper sheet P earliest accumulated in the inlet unit 2 (i.e., the leftmost one in FIG. 1). Namely, the earliest accumulated paper sheet is quickly positioned at the pickup position, and picked up by the pickup belt 4 by a suction force.

The paper sheet P picked up from the pickup position S is guided to the nip 8*c* of the conveyance belts 8*a* and 8*b*, and then guided to a further downstream side, with the front end of the paper sheet nipped by the nip 8*c*. The fact that the picked paper sheet P has reached the nip 8*c* is detected when the output of the sensor S5 is changed from "brightness" to "darkness." At this time, the running rate of the conveyance belts 8*a* and 8*b* is set to a value slightly higher than that of the pickup belt 4, which means that the paper sheet P is pulled out by the conveyance belts 8*a* and 8*b*.

When one or more paper sheets P are picked up simultaneously with a paper sheet P firstly fed to the pickup position S, the former paper sheets P are separated from the latter one by the separation roller 7. At this time, a negative pressure is produced on the periphery of the separation roller 7, and separation torque is exerted on the sleeve 7*c* in a direction opposite to the pickup direction. When a single paper sheet P is normally picked up, the sleeve 7*c* of the separation roller 7 is rotated in the pickup direction. In contrast, when two or more paper sheets are simultaneously picked up, the sleeve 7*c* is rotated in a direction opposite to the above, whereby the second and later paper sheets are returned and separated from the first paper sheet.

When superposed paper sheets P are separated and fed to the conveyance path 9 one by one, as described above, a gap is formed between the adjacent paper sheets P by executing on-off control of the negative pressure in the negative pressure chamber 5, or by intermittently running the pickup belt 4. The gap is determined in accordance with the processing rate of paper sheets P in a processing unit (which is not shown or described) connected to the conveyance path 9 and located downstream of the pickup device 1.

Specifically, to enhance the processing efficiency of the processing unit located downstream and impart a sufficient processing time, it is desirable to control the gap between adjacent paper sheets to a desired length. However, in the method of forming a gap by intermittently operating the pickup belt 4, it is difficult to highly accurately control the times required for accelerating and decelerating the belt, and hence slippage may occur between the belt and each paper sheet when the belt is accelerated or decelerated.

To this end, the embodiments employ a method of executing on-off control of the negative pressure in the negative pressure chamber 5. In particular, in the pickup device 1 of the invention, it is required for the pickup belt 4 to reliably pick up and hold, at desired timing, paper sheets P of different sizes, thicknesses, weights, materials, etc., positioned at the pickup position S. To satisfy the requirement, the embodiments are constructed such that a great amount of air can be instantly drawn from and introduced into the vacuum-pressure chamber 5.

Figure 4:
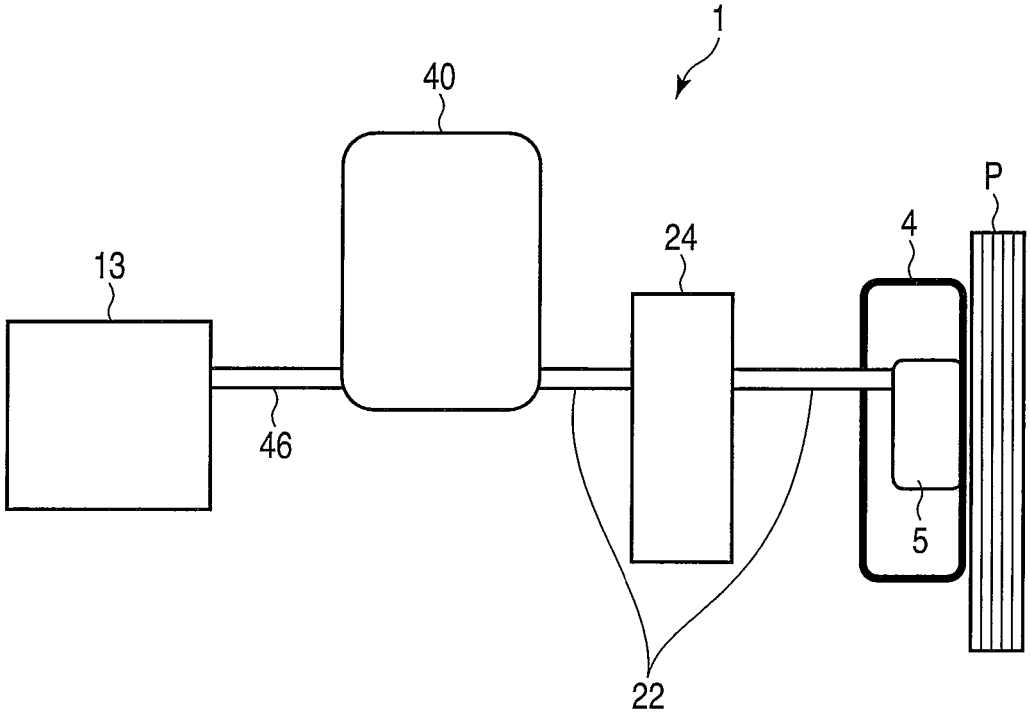
FIG. 4 is a schematic view illustrating the essential part of a pickup device according to a reference example of the invention.

FIG. 4 schematically shows a structure example of the essential part of the pickup device 1. The pickup device 1 comprises the negative pressure chamber 5 provided inside the endless pickup belt 4, the pump 13 for drawing air from the negative pressure chamber 5, a valve unit 24 for executing on-off control of the negative pressure in the negative pressure chamber 5, and a filter unit 40 (filter device) interposed between the valve unit 24 and the pump 13.

In the embodiments, the pump 13 is, for example, a KRF-series dry pump made by Orion Machine Corporation. This dry pump is a vacuum pump that can execute a reliable suction operation with no pulsation, and also execute a reliable exhaustion operation with no pulsation. In this dry pump, exhausted gas can be used for pickup control of paper sheets P. The use of the exhausted gas will be described later in the embodiments below.

Figure 5:
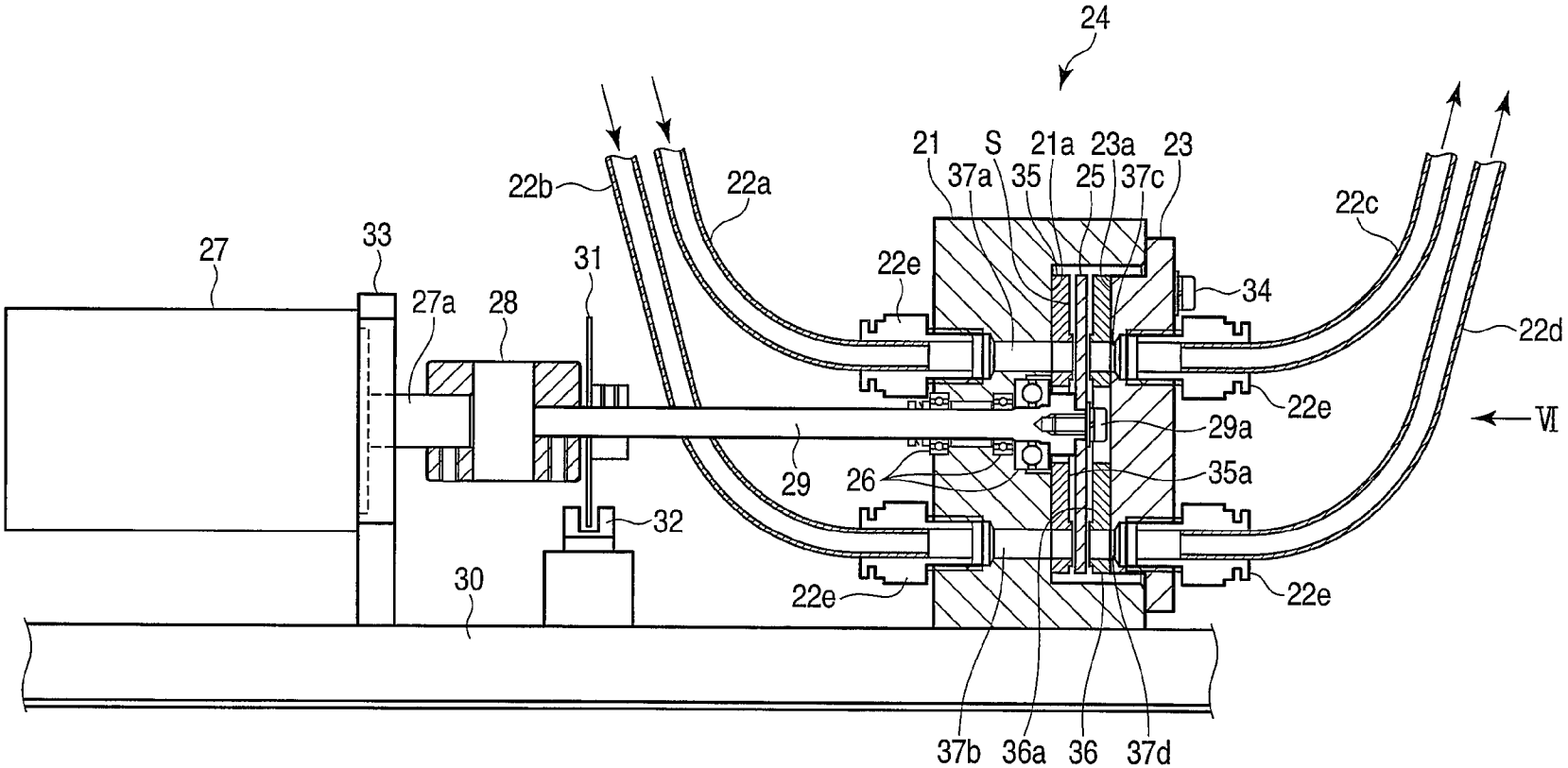
FIG. 5 is a sectional view illustrating a valve unit incorporated in the pickup device of FIG. 4.
Figure 6:
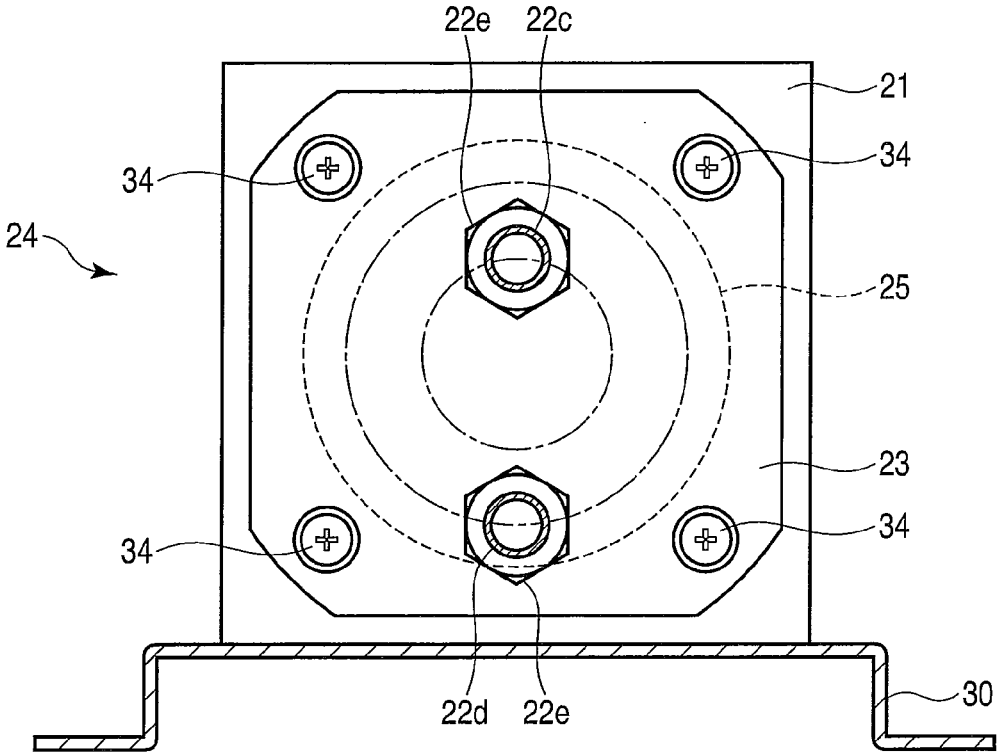
FIG. 6 is a side view taken in the direction indicated by arrow VI of FIG. 5.
Figure 7:
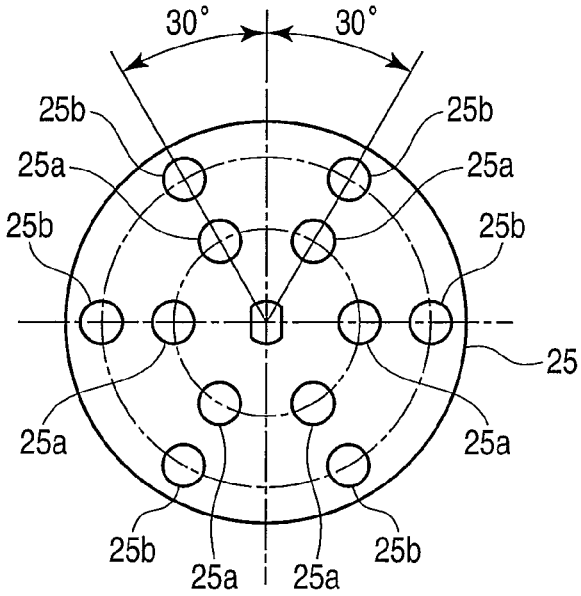
FIG. 7 is a schematic view illustrating a shielding plate incorporated in the pickup device of FIG. 5.

FIG. 5 is a sectional view illustrating the valve unit 24. FIG. 6 shows the valve unit 24 seen in the direction indicated by the arrow VI of FIG. 5. FIG. 7 is a schematic view, illustrating a shielding plate 25 incorporated in the valve unit 24 of FIG. 5.

The valve unit 24 is connected to two first suction tubes 22*a* and 22*b* (first passages), two second suction tubes 22*c* and 22*d* (second passages). Namely, the two first suction tubes 22*a* and 22*b* are connected to the negative pressure chamber 5, and the two second suction tubes 22*c* and 22*d* are connected to a filter unit 40 described later in detail. In other words, the four suction tubes 22*a*, 22*b*, 22*c* and 22*d* are included in suction tube 22 shown in FIG. 4, and a single valve unit 24 is provided across the suction tubes.

The valve unit 24 comprises a substantially rectangular first block 21 (first member), a second block 23 (second member) opposing the first block, a substantially circular shielding plate 25 rotatably provided in a space S defined between the first and second blocks 21 and 23, and a motor 27 (driving means) for rotating the shielding plate 25.

The rotary shaft 27*a* of the motor 27 is coaxially connected to the driving shaft 29 of the shielding plate 25 via a coupling 28. The driving shaft 29 extends through the first block 21 and rotatably attached thereto via a plurality of bearings 26. The shielding plate 25 is secured to the tip of the driving shaft 29 by a screw 29*a*.

A reference position detection plate 31 is secured to the driving shaft 29 of the shielding plate 25, and a sensor 32 is secured to a base 30 for detecting, during the rotation of the reference position detection plate 31, a notch (not shown) formed in the edge of the reference position detection plate 31. Further, the above-mentioned first block 21 is secured to the base 30, and the above-mentioned motor 27 is secured to the base 30 via a bracket 33. The notch of the reference position detection plate 31 is used to detect communication holes (described later) formed in the shielding plate 25. Based on the detection result of the sensor 32, the controller 10 drives the motor 27 to position the shielding plate 25 at a desired angular position.

The first suction tubes 22*a* and 22*b* are coupled to the first block 21 from behind the first block 21 via respective joints 22*e*, and the second suction tubes 22*c* and 22*d* are coupled to the second block 23 from behind the second block 23 via respective joints 22*e*. More specifically, the suction tubes 22*a* to 22*d* are arranged such that the first suction tube 22*a* substantially coaxially opposes the second suction tubes 22*c*, and the first suction tube 22*b* substantially coaxially opposes the second suction tubes 22*d*. In this state, the second block 23 is fastened to the first block 21 by a plurality of bolts 34.

The first block 21 has an opposing surface 21*a* that opposes the second block 23 (i.e., the second suction tubes 22*c* and 22*d*), while the second block 23 has an opposing surface 23*a* that opposes the first block 21 (i.e., the first suction tubes 22*a* and 22*b*). The opposing surfaces 21*a* and 23*a* are formed circular, have a size larger than the shielding plate 25, and oppose each other in parallel.

A shielding member 35 having substantially the same diameter as the shielding plate 25 is stuck to the opposing surface 21*a* of the first block 21. Similarly, a shielding member 36 having substantially the same diameter as the shielding plate 25 is stuck to the opposing surface 23*a* of the second block 23. A space S for receiving the shielding plate 25 so that it can rotate is defined between the shielding members 35 and 36 stuck to the opposing surfaces 21*a* and 23*a* of the first and second blocks 21 and 23, respectively. Namely, the space S is defined between the opposing surfaces 21*a* and 23*a*. The shielding plate 25 rotates in the space S.

The first block 21 has two long holes 37*a* and 37*b* (first holes). One end of the long hole 37*a* communicates with the first suction tube 22*a*, and one end of the long hole 37*b* communicates with the first suction tube 22*b*. The long holes 37*a* and 37*b* extend through the shielding member 35 stuck to the opposing surface 21*a* of the first block 21, and have the other ends thereof exposed to the space S.

Similarly, the second block 23 has two long holes 37*c* and 37*d* (second holes). One end of the long hole 37*c* communicates with the second suction tube 22*c*, and one end of the long hole 37*d* communicates with the second suction tube 22*d*. The long holes 37*c* and 37*d* extend through the shielding member 36 stuck to the opposing surface 23*a* of the second block 23, and have the other ends thereof exposed to the space S. The long holes 37*a* and 37*c* substantially coaxially oppose each other, and the long holes 37*b* and 37*d* substantially coaxially oppose each other.

The distance between the opposing surfaces 35*a* and 36*a* that oppose the space S between the shielding members 35 and 36 is slightly greater than the thickness of the shielding plate 25. However, the distance between the shielding members 35 and 36 is slightly shorter at the portions thereof, at which the other ends of the long holes 37*a* to 37*d* are exposed to the space S, than at the other portions. In other words, the annular portions of the shielding members 35 and 36, which define the peripheries of the other ends of the long holes 37*a* to 37*d*, slightly protrude in the space S, so that the other ends of the long holes 37*a* to 37*d* are blocked by the shielding plate 25 in order to minimize the amount of air leaking through the space S.

With this structure, the amount of air leaking through the space S is minimized. However, to enable the shielding plate 25 to rotate, the shielding members 35 and 36 do not tightly contact the shielding plate 25. Namely, in the valve unit 24 as the reference example, it is not necessary to close the air passage in an airtight manner (i.e., there is no problem if a small amount of air runs out). The use of the valve unit 24 is limited to the case where some air leak is permitted.

As shown in FIG. 7, a plurality of communication through holes 25*a* and 25*b* are formed in the shielding plate 25. In this reference example, all communication holes 25*a* and 25*b* are formed to be circular and have substantially the same diameter as the suction tubes 22*a* to 22*d*. Although the communication holes 25*a* and 25*b* are not limited to a circular shape, it is preferable that they be formed circular to minimize the resistance of air in view of the fact that the suction tubes 22*a* to 22*d* are generally cylindrical.

In the reference example, the communication holes 25*a* and 25*b* are formed in the positions shown in FIG. 7. That is, six communication holes 25*a* are formed at circumferentially regular intervals in those portions of the shielding plate 25 that are positioned at a radially short distance from the center of the substantially circular plate 25. Further, six communication holes 25*b* are formed at circumferentially regular intervals in those portions of the shielding plate 25 that are positioned at a radially long distance from the center of the substantially circular plate 25.

The inner six communication holes 25*a* are positioned so that they overlap with the long hole 37*a* of the first block 21 and the long hole 37*c* of the second block 23 during the rotation of the shielding plate 25 to make the upstream-side and second suction tubes 22*a* and 22*c* communicate with each other. Similarly, the outer six communication holes 25*b* are positioned so that they overlap with the long hole 37*b* of the first block 21 and the long hole 37*d* of the second block 23 during the rotation of the shielding plate 25 to make the upstream-side and second suction tubes 22*b* and 22*d* communicate with each other.

For instance, when the motor 27 is rotated under the control of the controller 10 to rotate the shielding plate 25 and stop the same where one of the inner communication holes 25*a* overlaps with the inner long holes 37*a* and 37*c*, the outer communication hole 25*b* located symmetrical with the one inner communication hole 25*a* with respect to the center of the shielding plate 25 overlaps with the outer long holes 37*b* and 37*d*, instead of the outer communication hole 25*b* located on the same radial line as the one inner communication hole 25*a*. This state appears whenever the shielding plate 25 rotates through 60°, and hence the valve unit 24 is opened six times during one rotation of the plate 25. Accordingly, the open and closed states of the valve unit 24 can be alternately realized by intermittently rotating the shielding plate 25 in units of 30°.

As described above, by locating one of the fluid passages radially inside and the other fluid passage radially outside, a greater number of communication holes 25*a* and 25*b* can be formed in the shielding plate 25, and the valve unit 24 can be opened at a greater number of angular positions (six positions in the reference example). Further, the amount of rotation of the shielding plate 25 between the open state and the closed state can be reduced, thereby increasing the response speed of the valve unit 24. In addition, by simultaneously opening/closing the two fluid passages, the flow rate of air can be increased when each fluid passage is opened. In this case, the inertia of the shielding plate 25 is prevented from increasing in accordance with the number of the fluid passages, thereby preventing reduction of the response speed of the valve unit 24.

Figure 8:
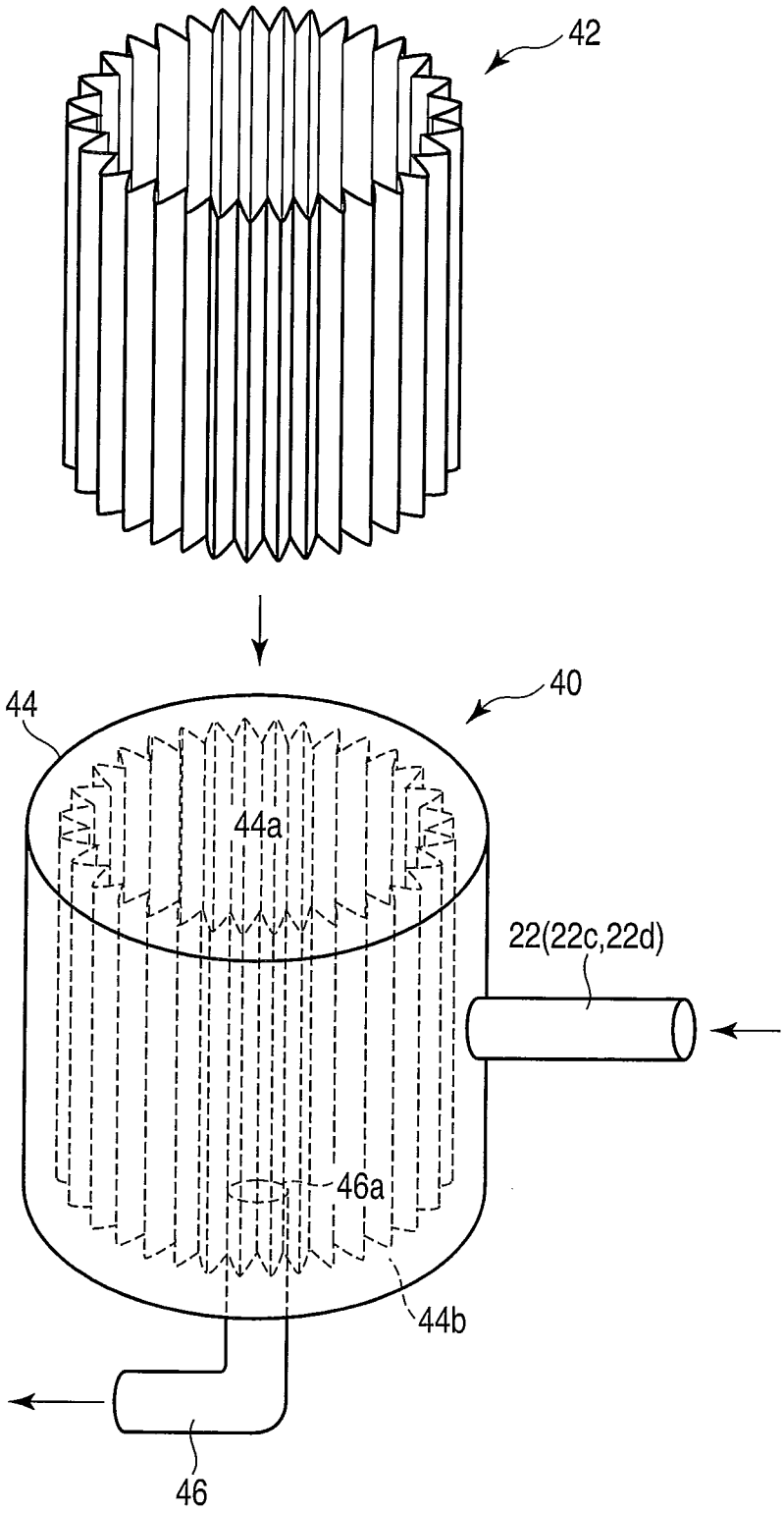
FIG. 8 is an exploded perspective view illustrating a filter unit incorporated in the pickup device of FIG. 4.

FIG. 8 roughly shows an example of the filter unit 40. In this reference example, to eliminate dust from the air to be drawn by the pump 13, the filter unit 40 is provided between the pump 13 and the valve unit 24 as shown in FIG. 4. The filter unit 40 is an air filter of a relatively large capacity, and is of a type that has an internal space. In the pickup device 1 of this example that processes a large number of paper sheets P, it is necessary to use a filter unit that can eliminate a relatively large amount of dust.

When the filter unit 40 is provided on the suction side of the pump 13, the pump 13 is prevented from clogging, and hence high performance of the pump 13 can be maintained. Note that if the conventional electromagnetic valve is used, it is necessary to provide a filter unit between the electromagnetic valve and the vacuum chamber 5 to protect the electromagnetic valve. However, in the valve unit 24 constructed as the above, there is no possibility of clogging and hence it is not necessary to provide the filter unit upstream side of the valve unit 24. Rather, since the filter unit 40 is not provided between the negative pressure chamber 5 and the valve unit 24, an advantage can be obtained.

As shown in FIG. 8, the filter unit 40 comprises an annular filter main body 42 formed by accordion-folding a nonwoven sheet, and a cylindrical container 44 containing the filter main body 42. The two second suction tubes 22 (22*c*, 22*d*) for introducing air into the filter unit 40, only one of which is shown, are connected to the periphery of the cylindrical container 44. A third suction tube 46 for exhausting air from the filter unit 40 is connected to the bottom 44*b* of the cylindrical container 44. The opposite ends of the cylindrical filter main body 42 are in tight contact with the top 44*a* and bottom 44*b* of the cylindrical container 44 to prevent air leakage.

In this structure, the air introduced into the filter unit 40 through the suction tubes 22 fills the clearance between the filter main body 42 and the inner wall of the cylindrical container 44, and passes through the filter main body 42 into the inside thereof. After the air passes through the filter main body 42, the dust contained in the air is trapped outside the filter main body 42. The clean air having passed through the filter main body 42 is exhausted through the third suction tube 46 via an opening 46*a* formed in the bottom 44*b* of the cylindrical container 44.

To enable air to flow through the suction tubes 22 and 46 in the structure in which the filter unit 40 constructed as the above is interposed between the pump 13 and the valve unit 24, it is necessary to set the interior of the cylindrical container 44 of the filter unit 40 to a pressure lower than the atmospheric pressure and almost equal to the pressure in the negative pressure chamber 5. To this end, in the pickup device 1 of the reference example, the pump 13 is operated even which the valve unit 24 is closed (in this state, a negative pressure is not applied to a paper sheet P positioned at the pickup position S), thereby maintaining the interior of the cylindrical container 44 at a negative pressure. As a result, when the valve unit 24 is opened (i.e., when the negative chamber 5 is made to communicate with the filter unit 40), the negative pressure in the filter unit 40 is used to quickly draw a great amount of air to thereby instantly reduce the interior of the negative pressure chamber 5 to a desired pressure.

The on-off control of the valve unit 24 constructed as the above will now be described.

When the front end of a paper sheet P picked up to the conveyance path 9 by the pickup belt 4 reaches the sensor S5 (see FIG. 1), the controller 10 determines that the paper sheet P has been transferred to the nip 8*c* of the conveyance belts 8*a* and 8*b*, and closes the valve unit 24. Alternatively, when one of the sensors S1 to S5 arranged along the conveyance path 9 detects the rear end of the paper sheet P in a direction of conveyance, the controller 10 closes the valve unit 24. Namely, at this time, the controller 10 rotates the shielding plate 25, and stops it at a position at which the shielding plate 25 closes the suction tubes 22*a*, 22*b*, 22*c* and 22*d*.

As a result, the drawing of air from the negative pressure chamber 5 is stopped. This enables the paper sheet P to be reliably conveyed to the downstream side, held by the nip 8*c* of the conveyance belts 8*a* and 8*b*, and at the same time, prevents a disadvantage of holding subsequent paper sheets P by the pickup belt 4, thereby avoiding simultaneous pickup of two or more paper sheets P.

Upon detecting the gap between a first fed paper sheet P and a subsequent paper sheet P, the controller 10 opens the valve unit 24 to hold the subsequent paper sheet P on the pickup belt 4 using a negative pressure, thus starting the pickup of the subsequent paper sheet P. At this time, the controller 10 rotates the shielding plate 25, and stops it at a position at which the communication holes 25*a* and 25*b* of the shielding plate 25 communicate with the suction tubes 22*a*, 22*b*, 22*c* and 22*d*.

At this time, upon opening the valve unit 24, a great amount of air flows from the negative pressure chamber 5 to the cylindrical container 44 of the filter unit 40, and the pressure in the interior of the negative pressure chamber 5 is instantly reduced to a desired pressure, as is described above. Also, at this time, the pressure in the cylindrical container 44 of the filter unit 40 is maintained at a negative value, since the pump 13 is operated at all times to continue air drawing.

As a result, the corresponding suction tubes 22 communicate with each other to again draw air from the negative pressure chamber 5, thereby holding the subsequent paper sheet P. At this time, the gap between the paper sheets P can be controlled by adjusting the timing of opening the valve unit 24. To be more specific, if the timing of opening the valve unit 24 is delayed, the gap is increased, whereas if the timing is advanced, the gap is reduced. The gap between a first fed paper sheet P and a subsequent paper sheet P is detected when the output of one of the sensors S1 to S4 becomes high.

As described above, in the reference example, since a large amount of air is instantly drawn from the negative pressure chamber 5 via the suction tubes 22 by opening the valve unit 24 at second timing at which a paper sheet P is held on the pickup belt 4 by a negative pressure, the pressure in the negative pressure chamber 5 can be instantly set to a negative value at desired timing, thereby accurately controlling the gap between paper sheets P to a desired length. Further, the cycle of pickup of each paper sheet P can be shortened, thereby realizing high-speed pickup of paper sheets P.

In particular, the valve unit 24 of the reference example can simultaneously open/close two fluid passages, and hence a great amount of air can be drawn from the negative pressure chamber 5 in a short time. Furthermore, in the valve unit 24 of the reference example, a desired number of tubes can be connected to the valve unit 24, and a desired number of communication holes can be formed at desired positions. Therefore, three or more fluid passages can be simultaneously opened/closed. Also in this case, the whole device can be made compact. In addition, if the diameter of each tube and that of each communication hole are increased, each fluid passage becomes thick. Thus, the fluid passages can be easily formed large in diameter, therefore the flow of air can be easily increased.

In contrast, in the case of using the conventional solenoid valve for the same purpose as the present invention, to execute on-off control of a plurality of fluid passages, it is necessary to provide solenoids for the respective fluid passages, which inevitably makes the device complex, large and expensive. Further, in the solenoid valve, since the fluid passing resistance thereof is high and hence it is difficult to pass therethrough a large amount of air at a time, the negative pressure chamber 5 cannot instantly be set to a negative pressure. Further, in the case of using a plurality of solenoid valves, it is necessary to simultaneously on-off control all solenoid valves, which results in complex control. Furthermore, in the case of increasing the diameter of the fluid passages themselves, the inertia of each plunger is inevitably increased, and hence the response of each solenoid valve becomes low.

In contrast, in the valve unit 24 of the reference example, a plurality of fluid passages can simultaneously be opened/closed, and a desired number of fluid passages, which can be simultaneously on-off controlled, can be set. Further, the diameter of each fluid passage can be arbitrarily set, and control can be realized using only a single valve. In addition, since the valve unit 24 of the reference example has a structure for passing air linearly, it has little air passing resistance, therefore permits a large amount of air to pass therethrough at a time.

In the reference example, the negative pressure chamber 5 is constantly set to a negative pressure by operating the pump 13 at all times. However, a relief valve (not shown) is provided in the pump 13 to prevent the pressure in the negative pressure chamber 5 from lowering below a preset value. As a result, even if the pump 13 is constantly operated, the pressure in the negative pressure chamber 5 is prevented from lowering continuously.

Furthermore, in the reference example, the filter unit 40 is interposed between the pump 13 and the valve unit 24 as shown in FIG. 4, and hence the pressure in the negative pressure chamber 5 can be reduced to a desired value more quickly than the case of using no filter unit 40.

To be more specific, in the pickup device 1 of the reference example, when the valve unit 24 is closed, the air in the filter unit 40 located downstream of the valve unit 24 with respect to the suction direction of air is constantly drawn by the pump 13. This means that the cylindrical container 44 of the filter unit 40 is constantly set at a negative pressure. Accordingly, immediately after the valve unit 24 is opened, a great amount of air can be rapidly drawn from the negative pressure chamber 5 using the reduced internal pressure of the filter unit 40. Thus, the internal pressure of the negative pressure chamber 5 can be instantly reduced to a desired value.

In contrast, if the pump 13 is directly connected to the valve unit 24 without the filter unit 40 therebetween, it starts drawing of air from the negative pressure chamber 5 upon opening the valve unit 24. Therefore, in this case, only suction of air based on the suction capacity of the pump 13 is executed.

Further, if the filter unit 40 having the above-mentioned internal space is provided between the negative pressure chamber 5 and the valve unit 24, suction of air from the negative pressure chamber 5 cannot be started even after the valve unit 24 is opened and suction of air from the negative pressure chamber 5 is started, unless the pressure in the cylindrical container 44 of the filter unit 40 is reduced to a preset negative pressure.

Namely, it is advantageous to interpose the filter unit 40 with the internal space between the pump 13 and the valve unit 24, as in the pickup device 1 of the reference example. In this case, it is necessary to use the valve unit 24 that is free from clogging due to dust, instead of the conventional solenoid valve including a plunger moved by an electromagnetic force.

Figure 9:
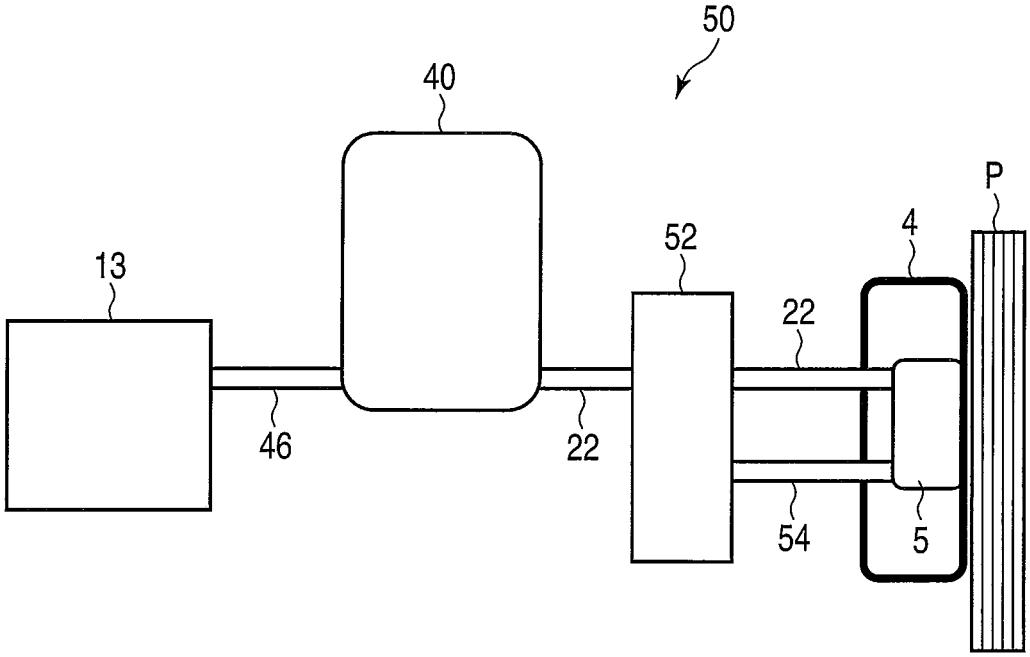
FIG. 9 is a schematic view illustrating the essential part of a pickup device according to a first embodiment of the invention.

FIG. 9 shows the essential part of a pickup device 50 according to a first embodiment of the present invention. The pickup device 50 is similar to the pickup device 1 of the reference example except that in the former, a valve unit 52 is connected to an air inlet tube 54 for introducing air into the negative pressure chamber 5. Accordingly, elements similar to those of the above-described reference example are denoted by corresponding reference numbers, and are not described in detail.

The valve unit 52 is provided across a suction tube 22 that connects the negative pressure chamber 5 to the filter unit 40, and is also connected to the air inlet tube 54 led from the negative pressure chamber 5. The valve unit 52 has substantially the same structure as the valve unit 24 of the reference example.

As shown in FIGS. 10A to 10D, the valve unit 52 differs from the valve unit 24 of the reference example in the positions of communication holes 56*a* and 56*b* formed in a shielding plate 56, the position of one opening 58*a* of the suction tube 22 communicating with a space S in which the shielding plate 56 rotates, the opening 58*b* of the air inlet tube 54 communicating with the space S, and the air flow directions in these two tubes (fluid passages). Namely, in the first embodiment, the one of the two fluid passages extending through the valve unit 52 is used for drawing air from the negative pressure chamber 5, and the other fluid passage is used for introducing outside air.

FIGS. 10A to 10D are schematic views useful in explaining the positional relationship between the communication holes 56*a* and 56*b* of the shielding plate 56 of the valve unit 52, the opening 58*a* of the suction tube 22, and the opening 58*b* of the air inlet tube 54. Further, FIGS. 10A to 10D show the cases where the angular position of the shielding plate 56 are shifted in units of 90°. More specifically, each of FIGS. 10A to 10D shows the relative positions of the communication holes 56*a* and 56*b* and the openings 58*a* and 58*b*, assumed when the shielding plate 56 are rotated in units of 90°. FIG. 11 is a timing chart useful in explaining pressure variations in the negative pressure chamber 5 that occur when the shielding plate 56 are sequentially rotated as shown in FIGS. 10A to 10D.

Figure 10A:
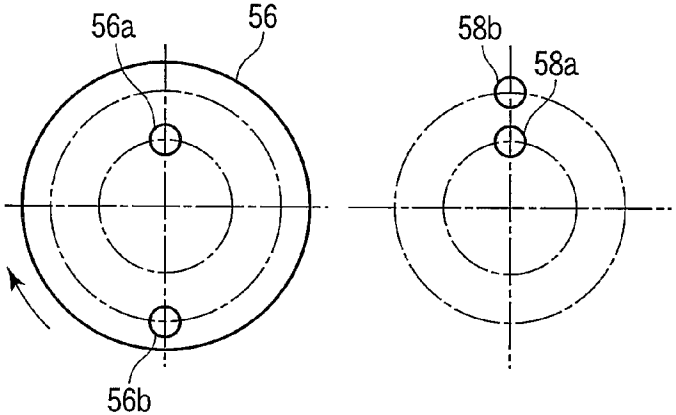
FIGS. 10A to 10D are schematic views useful in explaining the operation of the valve unit incorporated in the pickup device of FIG. 9.
Figure 11:
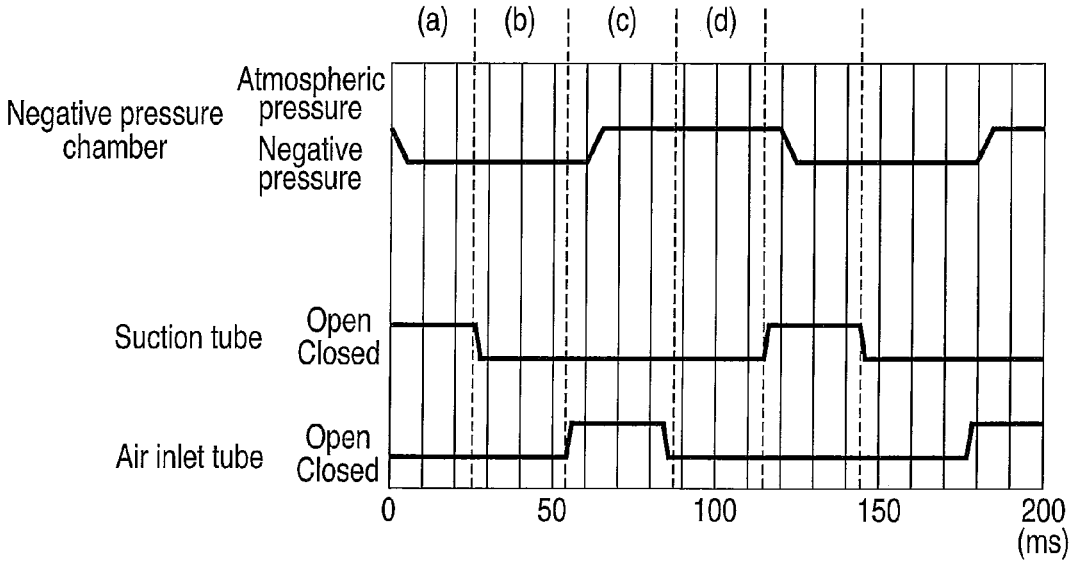
FIG. 11 is a timing chart useful in explaining variations in the internal pressure of a negative pressure chamber, along with FIGS. 10A to 10D.

When the shielding plate 56 is rotated to the angular position shown in FIG. 10A, the radially inner communication hole 56*a* of the shielding plate 56 overlaps with the opening 58*a* of the suction tube 22, thereby causing the negative pressure chamber 5 and the filter unit 40 to communicate with each other. At this time, the opening 58*b* of the air inlet tube 54 is blocked by the shielding plate 56, therefore the negative pressure chamber 5 does not open to the atmosphere.

As described above, when the negative pressure chamber 5 and the filter unit 40 are made to communicate with each other with the air inlet tube 54 closed and the suction tube 22 open, the air in the negative pressure chamber 5 is all together introduced into the cylindrical container 44 of the filter unit 40 that has its internal pressure reduced so far by the air drawing operation of the pump 13. Accordingly, the pressure in the negative pressure chamber 5 is rapidly reduced to a negative value. At this time, since the air drawing operation of the pump 13 is continued, the air in the negative pressure chamber 5 is kept drawn by the pump 13 via the filter unit 40.

Figure 10B:
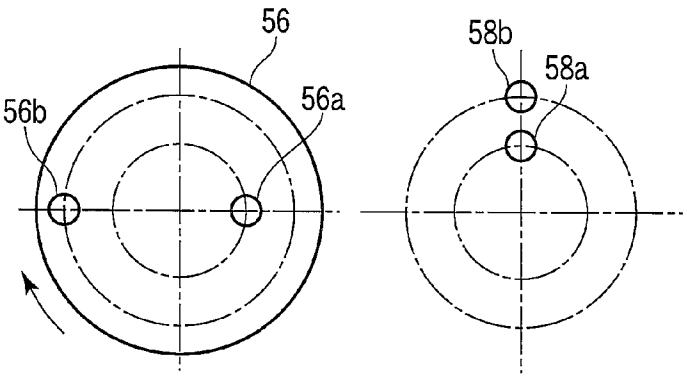

After that, the shielding plate 56 is clockwise rotated through 90° as indicated by the arrow, and is stopped at the angular position shown in FIG. 10B. In this state, both the air inlet tube 54 and the suction tube 22 are closed, and hence drawing of air from the negative pressure chamber 5 is stopped. At this time, however, little air flows into the negative pressure chamber 5, therefore the internal negative pressure of the negative pressure chamber 5 is substantially maintained. Namely, the state shown in FIG. 11(*b*) is assumed. When the negative pressure is thus maintained in the negative pressure chamber 5, a paper sheet P is picked by the pickup belt 4 through the negative pressure.

Figure 10C:
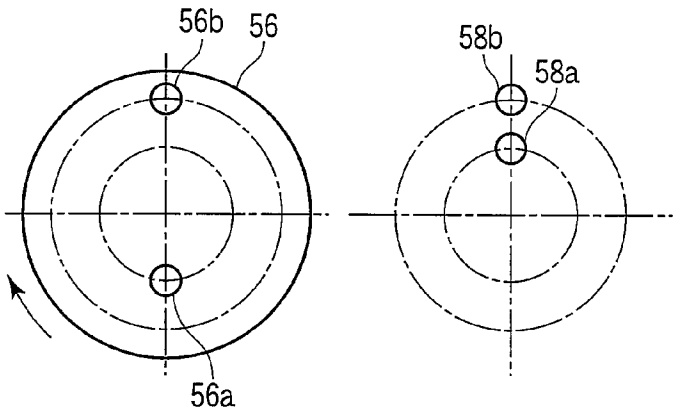

Subsequently, the shielding plate 56 is further clockwise rotated through 90°, and stopped at the position shown in FIG. 10C. In this state, the suction tube 22 is kept closed, and the radially outer communication hole 56*b* of the shielding plate 56 overlaps with the opening 58*b* of the air inlet tube 54, whereby the negative pressure chamber 5 is opened to the atmosphere, and its internal pressure is instantly returned to the atmospheric pressure. Namely, the state shown in FIG. 11(*c*) is assumed. As a result, the paper sheet P held on the pickup belt 4 by a negative pressure is released therefrom.

Figure 10D:
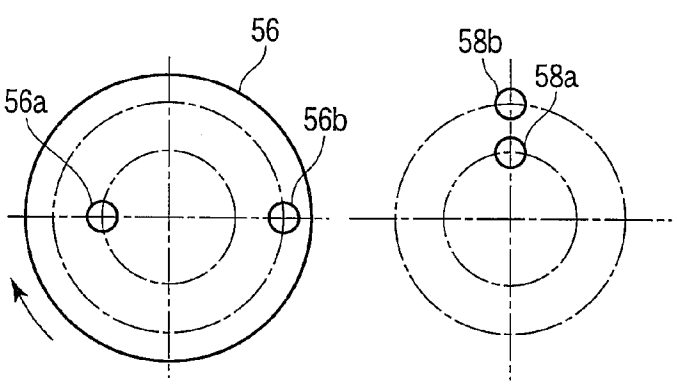

Thereafter, the shielding plate 56 is further clockwise rotated through 90°, and stopped at the position shown in FIG. 10D. In this state, both the suction tube 22 and the air inlet tube 54 are blocked, and the interior of the negative pressure chamber 5 is substantially maintained at the atmospheric pressure. Namely, the state shown in FIG. 11(*d*) is assumed. By thus returning the internal pressure of the negative pressure chamber 5 to the atmospheric pressure, the previously picked paper sheet P is conveyed, and a gap is formed between this paper sheet P and a subsequent paper sheet P.

As described above, whenever the shielding plate 56 is rotated through 360°, one paper sheet P is picked up. Accordingly, by continuously rotating the shielding plate 56, a plurality of paper sheets P can be sequentially picked up with a preset gap defined between each pair of adjacent paper sheets.

The pickup device 50 of the first embodiment can provide the same advantage as the pickup device 1 of the reference example. Namely, when a paper sheet P positioned at the pickup position S is held on the pickup belt 4 by a negative pressure, a large amount of air can be instantly drawn via the negative pressure chamber 5, and therefore the paper sheet P can be accurately held on the pickup belt 4 at desired timing. Even a large and/or heavy paper sheet can be held on the pickup belt 4 at desired timing. As a result, high-speed pickup of paper sheets P can be realized as in the reference example.

Moreover, in the pickup device 50 of the first embodiment, the negative pressure exerted on a paper sheet P to hold it on the belt 4 can be more quickly released than in the above-described reference example. As a result, simultaneous pickup of two or more paper sheets P can be more reliably avoided.

Figure 12:
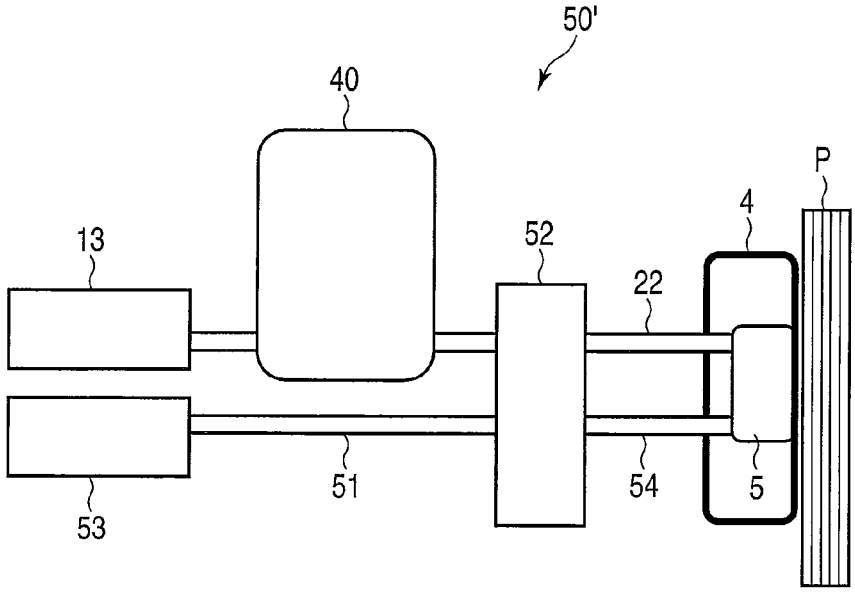
FIG. 12 is a schematic view illustrating a modification of the pickup device of FIG. 9.

FIG. 12 shows the essential part of a pickup device 50' according to a modification of the first embodiment. The pickup device 50' of the modification has a structure in which the valve unit 52 is connected to a blower 53 (air supply unit) via a blower tube 51, as well as to the pump 13. Except for this structure, the pickup device 50' has the same structure as the pickup device 50 of the first embodiment. Therefore, in this modification, elements similar to those in the pickup device 50 of the first embodiment are denoted by corresponding reference numbers, and are not described in detail. Also in the pickup device 50', the valve unit 52 is operated in the same way as in the pickup device 50, and hence no description is given of the operation of the valve unit 52, either.

In the pickup device 50' of the modification, since air is positively introduced into the negative pressure chamber 5 via the blower 53 when the negative pressure exerted on a paper sheet P to hold it on the belt 4 is quickly released, the internal pressure of the negative pressure chamber 5 can be returned to the atmospheric pressure more quickly to thereby realize more accurate negative pressure control than the pickup device 50 of the first embodiment.

Figure 13:
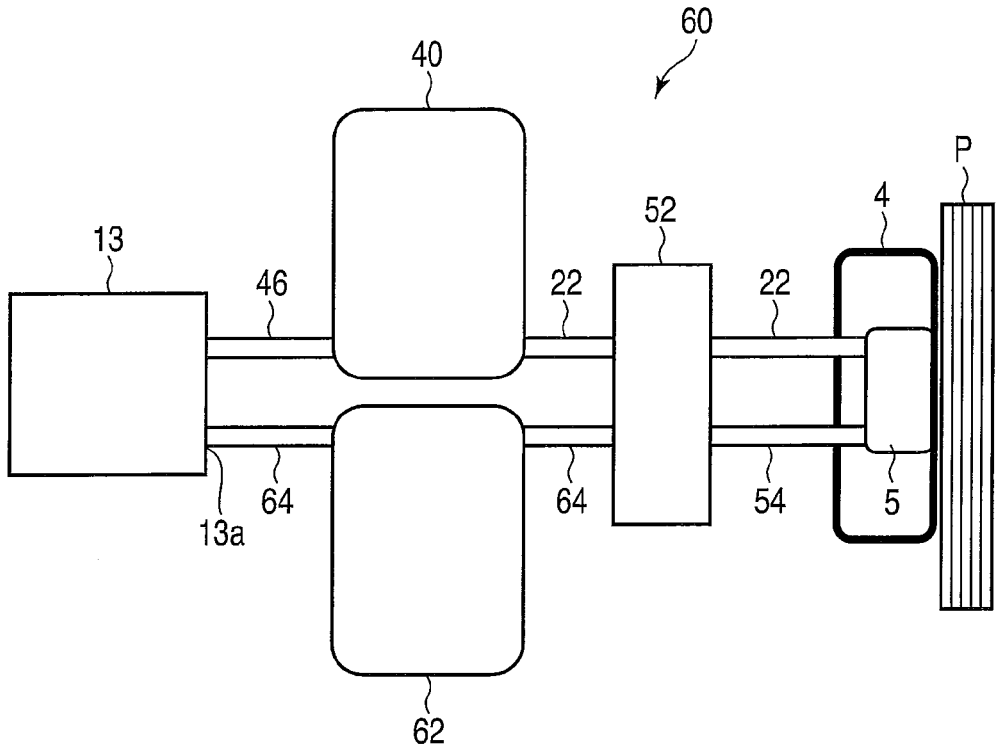
FIG. 13 is a schematic view illustrating the essential part of a pickup device according to a second embodiment of the invention.

FIG. 13 shows the essential part of a pickup device 60 according to a second embodiment. The pickup device 60 has substantially the same structure as the pickup device 50 of the first embodiment, except that a surge tank 62 is additionally attached at the outside-air inlet side of the valve unit 52. Therefore, in the second embodiment, elements similar to those in the pickup device 50 of the first embodiment are denoted by corresponding reference numbers, and are not described in detail. Also in the pickup device 60, the valve unit 52 is operated in the same way as in the pickup device 50, and hence no description is given of the operation of the valve unit 52, either.

The surge tank 62 is provided across an introduction tube 64 that connects the inlet side opening 58*b* of the valve unit 52 to the exhaust port 13*a* of the pump 13. The surge tank 62 receives the exhaust air of the pump 13, pressurizes it, and guides the pressurized air into the negative pressure chamber 5. By virtue of the surge tank 62, the internal pressure of the negative pressure chamber 5 is increased by a stable air flow free from pulsation.

More specifically, the exhaust air of the pump 13 is introduced into the surge tank 62 to increase the internal pressure of the surge tank 62, with the outside-air inlet passage of the valve unit 52 closed. In this state, the outside-air inlet passage of the valve unit 52 is opened to supply a great amount of pressurized air from the surge tank 62 to the negative pressure chamber 5. Accordingly, the internal pressure of the negative pressure chamber 5, which is reduced to a negative pressure, can be instantly increased to the atmospheric pressure.

As described above, the second embodiment can provide the same advantage as the above-described first embodiment, and can more quickly return the internal pressure of the negative pressure chamber 5 to the atmospheric pressure to thereby realize more accurate negative pressure control than the first embodiment. As a result, paper sheets P can be sequentially picked up at desired timing.

Figure 14:
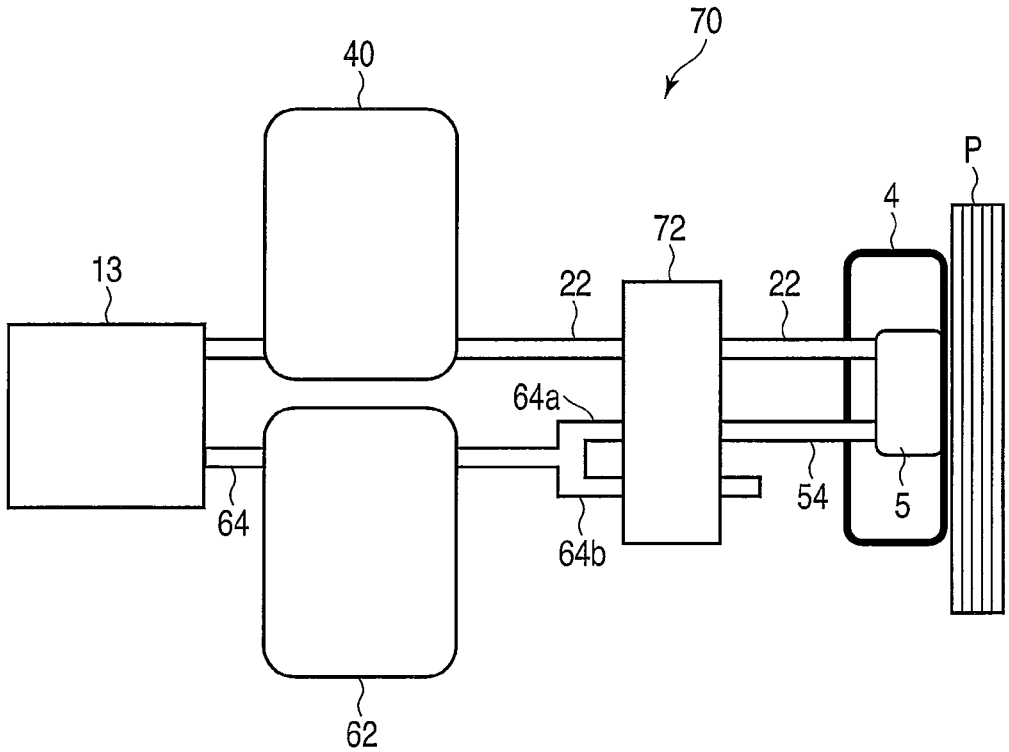
FIG. 14 is a schematic view illustrating the essential part of a pickup device according to a third embodiment of the invention.

FIG. 14 shows the essential part of a pickup device 70 according to a third embodiment. In the pickup device 70, the introduction tube 64 provided between the surge tank 62 and a valve unit 72 trifurcates into an introduction tube 64*a* and two exhaust tubes 64*b*, and the valve unit 72 is also used to open/close the exhaust tubes 64*b*. Except for this structure, the pickup device 70 of the third embodiment has substantially the same structure as the pickup device 60 of the second embodiment. Therefore, in the third embodiment, elements similar to those in the second embodiment are denoted by corresponding reference numbers, and are not described in detail.

FIGS. 15A to 15D are schematic views useful in explaining the positional relationship between communication holes 74*a* and 74*b* formed in the shielding plate 74 of the valve unit 72, an opening 76*a* of a suction tube 22, an opening 76*b* of an air inlet tube 54, and respective openings 76*c* and 76*c* of the two exhaust tubes 64*a* and 64*b*. Further, FIGS. 15A to 15D show the cases where the angular position of the shielding plate 74 are shifted in units of 90°. More specifically, each of FIGS. 15A to 15D shows the relative positions of the communication holes 74*a* and 74*b* and the openings 76*a*, 76*b* and 76*c*, assumed when the shielding plate 74 are rotated in units of 90°. FIG. 16 is a timing chart useful in explaining pressure variations in the negative pressure chamber 5 that occur when the shielding plate 56 are sequentially rotated as shown in FIGS. 15A to 15D.

Figure 15A:
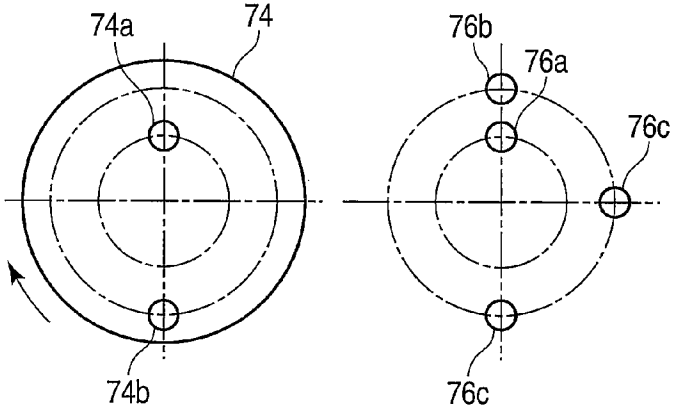
FIGS. 15A to 15D are schematic views useful in explaining the operation of the valve unit incorporated in the pickup device of FIG. 14.
Figure 16:
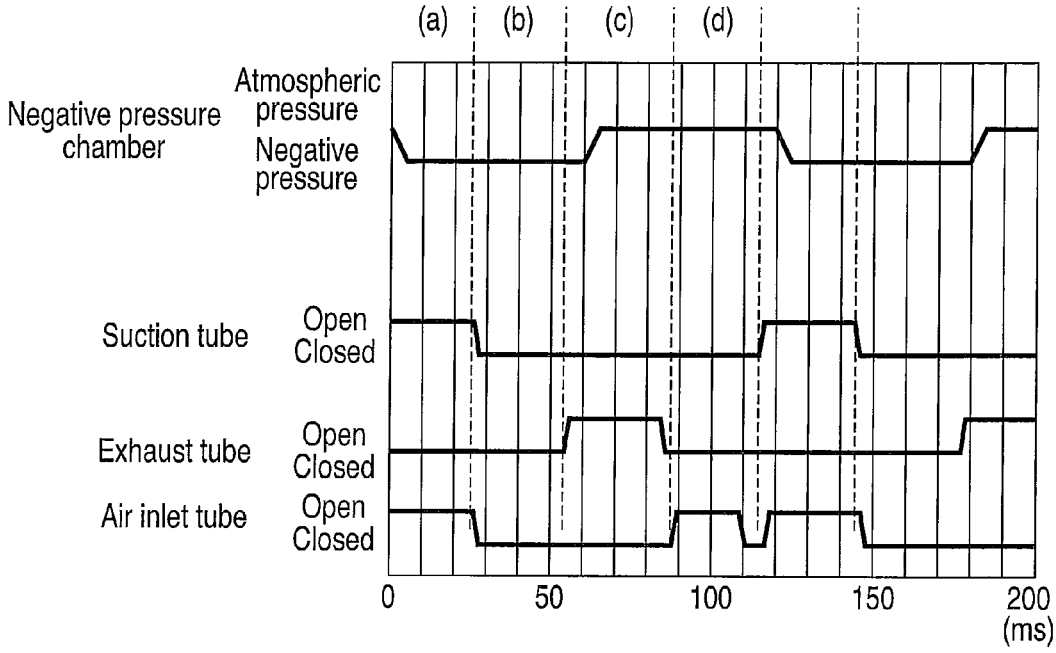
FIG. 16 is a timing chart useful in explaining variations in the internal pressure of a negative pressure chamber, along with FIGS. 15A to 15D.

When the shielding plate 74 is rotated to the angular position shown in FIG. 15A, the radially outer communication hole 74*b* of the shielding plate 74 overlaps with the opening 76*c* of one of the exhaust tubes 64*b*, and the radially inner communication hole 74*a* of the shielding plate 74 overlaps with the opening 76*a* of the suction tube 22. At this time, the opening 76*b* of the air inlet tube 54 for supplying air into the negative pressure chamber 5 is blocked by the shielding plate 74.

Since also in the pickup device 70, the pump 13 is constantly operated, air in the negative pressure chamber 5 is drawn, and the exhaust air of the pump 13 is exhausted to the outside of the pickup device 70 via the exhaust tube 64*b*. As a result, the internal pressure of the negative pressure chamber 5 is reduced to a negative value to cause the paper sheet P at the pickup position S to be held on the pickup belt 4 by the negative pressure. Namely, the state shown in FIG. 16(*a*) is assumed.

Figure 15B:
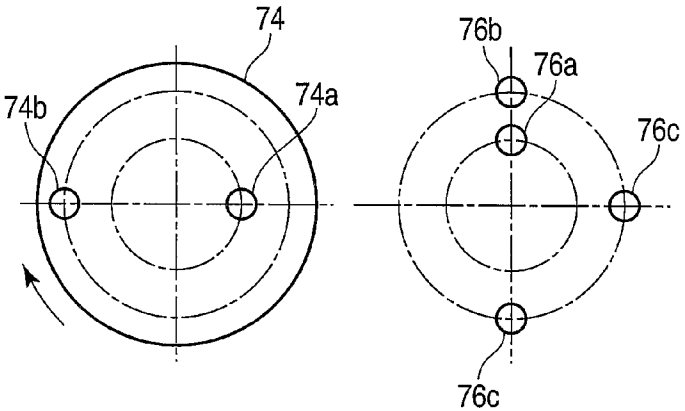

After that, the shielding plate 74 is clockwise rotated through 90° as indicated by the arrow in FIG. 15A, and is stopped at the angular position shown in FIG. 15B. At this position, the opening 76*c* of the one exhaust tube 64*b* and the opening 76*a* of the suction tube 22 are blocked with the air inlet tube 54 closed. In this state, little air flows into the negative pressure chamber 5, therefore the internal negative pressure of the negative pressure chamber 5 is substantially maintained. Namely, the state shown in FIG. 16(*b*) is assumed.

Also in this state, the pump 13 is continuously operated to draw air from the cylindrical container 44 of the filter unit 40, therefore the internal pressure of the container 44 is kept at a negative value, and at the same time, the air exhausted from the pump 13 is introduced into the surge tank 62 to increase its internal pressure.

Figure 15C:
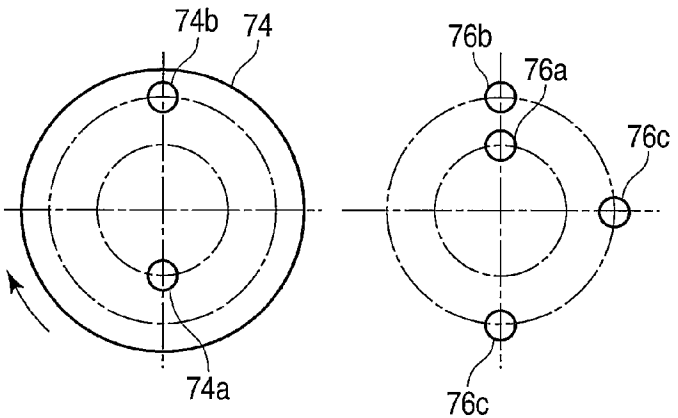

Subsequently, the shielding plate 74 is further clockwise rotated through 90°, and stopped at the position shown in FIG. 15C. In this state, the openings 76*c* of the exhaust tubes 64*b* and the opening 76*a* of the suction tube 22 are kept closed, and the radially outer communication hole 74*b* of the shielding plate 74 overlaps with the opening 76*b* of the air inlet tube 54. As a result, a great amount of air is rapidly introduced into the negative pressure chamber 5, and the internal pressure of the chamber 5 is instantly returned to the atmospheric pressure. Namely, the state shown in FIG. 16(*c*) is assumed.

When the state of FIG. 15B, i.e., the state of FIG. 16(*b*), is assumed, the internal pressure of the surge tank 62 is increased to compress the air in it. Accordingly, when the shielding plate 74 is rotated to the angular position of FIG. 15C to open the air inlet tube 54, the compressed air in the surge tank 62 is rapidly introduced into the negative pressure chamber 5 to instantly increase its internal pressure to the atmospheric pressure. Further, at this time, since both the exhaust tubes 64*b* are blocked by the shielding plate 74, the compressed air in the surge tank 62 is not exhausted, and the internal pressure of the negative pressure chamber 5 is effectively increased.

Figure 15D:
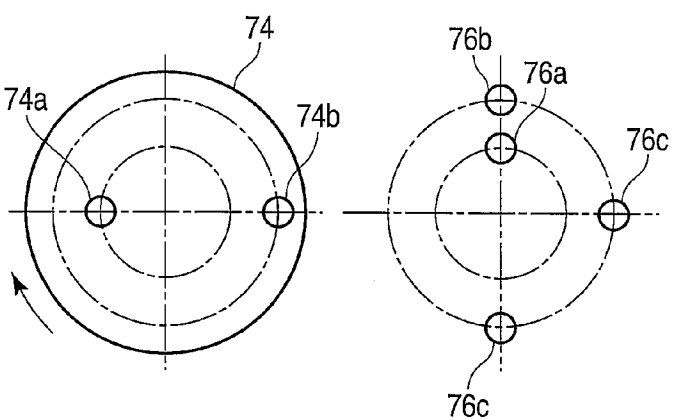

Thereafter, the shielding plate 74 is further clockwise rotated through 90°, and stopped at the position shown in FIG. 15D. In this state, the opening 76*c* of the other exhaust tube 64*b* communicates with the communication hole 74*b* of the shielding plate 74 with the opening 76*a* of the suction tube 22 closed, whereby the surge tank 62 is opened to the atmosphere.

As described above, to pick up the paper sheet P positioned at the pickup position S, the shielding plate 56 is rotated through 360°. By continuously rotating the shielding plate 74, a plurality of paper sheets P can be sequentially picked up with a preset gap defined between each pair of adjacent paper sheets.

As described above, the pickup device 70 of the third embodiment can provide the same advantages as the pickup devices of the first and second embodiments. In particular, the pickup device 70 of the third embodiment can effectively use the exhaust air of the pump 13, which enables the negative pressure in the negative pressure chamber 5 to be instantly eliminated when releasing the hold of a paper sheet P by the negative pressure, thereby realizing accurate control of negative pressure.

Figure 17:
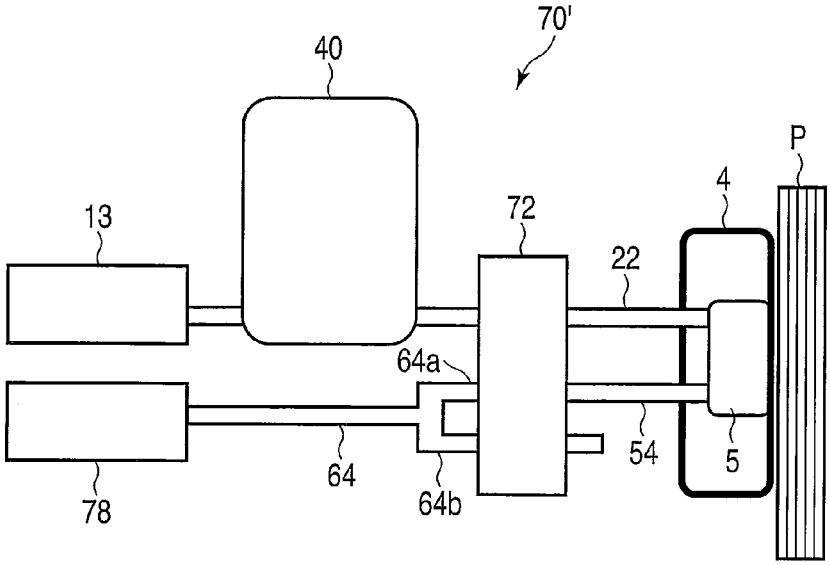
FIG. 17 is a schematic view illustrating a modification of the pickup device of FIG. 14.
Figure 18:
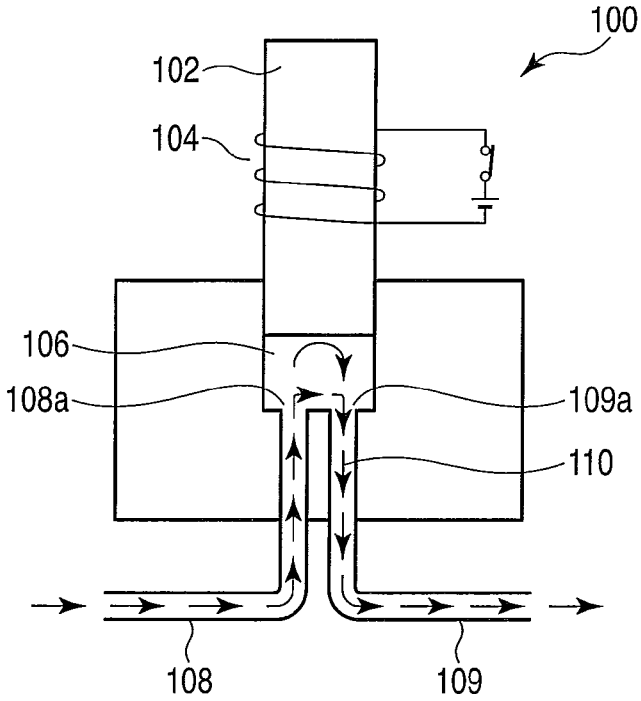
FIG. 18 is a schematic view of a conventional solenoid valve, illustrating the open state of the valve.
Figure 19:
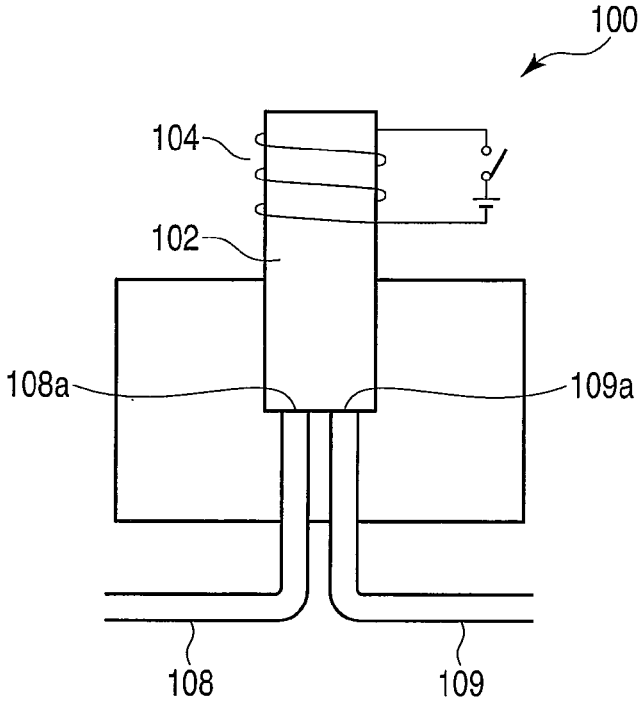
FIG. 19 is a schematic view of the solenoid valve of FIG. 18, illustrating the closed state of the valve.

FIG. 17 is a schematic view illustrating a pickup device 70' according to a modification of the pickup device 70 of the third embodiment. The pickup device 70' of the modification has a structure in which a blower 78 is employed instead of using the exhaust air of the pump 13, and the surge tank 62 is not employed. Except for this structure, the pickup device 70' has the same structure as the pickup device 70 of the third embodiment. Therefore, in this modification, elements similar to those in the pickup device 70 of the third embodiment are denoted by corresponding reference numbers, and are not described in detail. Also in the pickup device 70', the valve unit 72 is operated in the same way as in the pickup device 70, and hence no description is given of the operation of the valve unit 72, either.

When eliminating negative pressure exerted on a paper sheet P positioned at the pickup position S, the blower 78 is operated with the suction tube 22 and exhaust tubes 64*b* blocked and the air inlet tube 54 opened, thereby blowing air into the negative pressure chamber 5. At this time, since the exhaust tubes 64*b* are closed, the air from the blower 78 is prevented from leaking to the outside of the pickup device 70'.

Thus, even when the blower 78 is used instead of the exhaust air of the pump 13, the same advantage as that of the above-described embodiments can be obtained.

As described above, in the invention, the negative pressure in the negative pressure chamber 5 is controlled using a valve unit that can rapidly introduce a large amount of air and can rapidly interrupt the introduction of the air. This enables each paper sheet P to be held on the pickup belt 4 at desired timing, and enables a negative pressure exerted on each paper sheet P to be eliminated instantly. As a result, even relatively heavy paper sheets P can also be picked up easily, and hence the speed of paper sheet pickup can be increased.

Further, the invention is characterized in that the valve unit is free from clogging of dust, and the filter unit 40 is provided downstream of the valve unit with respect to the air suction direction of the negative pressure chamber 5. In particular, the filter unit 40 of the invention is an air filter having a relatively large internal space.

When the filter unit 40 having a large internal space is interposed between the valve unit and the negative pressure chamber 5, it is necessary to draw air from the filter unit 40 when the valve unit is opened to reduce the internal pressure of the negative pressure chamber 5. Accordingly, much time is required to reduce the internal pressure of the negative pressure chamber 5 to a desired value. In contrast, when the filter unit 40 is interposed between the valve unit and the pump 13 as in each of the above-described embodiments of the invention, the internal pressure of the negative pressure chamber 5 can be rapidly reduced, whereby more accurate negative-pressure control can be realized.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A paper sheet pickup device comprising:

a pickup member having a suction hole and configured to run along a paper sheet supplied to the pickup position;

a single negative pressure chamber provided on a reverse side of the pickup member and configured to apply negative pressure to the paper sheet at the pickup position through the suction hole;

a vacuum pump configured to draw air from the single negative pressure chamber;

a first opening and closing device configured to open and close a first passage that connects the pump and the single negative pressure chamber;

an air feeding device configured to feed in air to the single negative pressure chamber;

a second opening and closing device configured to open and close a second passage that connects the air feeding device and the single negative pressure chamber; and a controller configured to control the first opening and closing device to open the first passage after the second opening and closing device closes the second passage, when applying the negative pressure to the paper sheet at the pickup position, and also configured to control the second opening and closing device to open the second passage after the first opening and closing device closes the first passage, when resolving the negative pressure, wherein the air feeding device uses an exhaust of the pump, and wherein the first and second opening and closing device are configured as a single valve unit.

2. The paper sheet pickup device according to claim 1, wherein the single valve unit further includes:

a shielding plate configured to disconnect the first passage that connects a suction side of the pump and the single negative pressure chamber and disconnect the second passage that connects an exhaust side of the pump and the single negative pressure chamber; and moving means configured to move the shielding plate;

the shielding plate having a first communication hole that communicates with the first passage connecting the suction side of the pump and the single negative pressure chamber while the shielding plate is moving, and a second communication hole that communicates with the second passage connecting the exhaust side of the pump and the single negative pressure chamber while the shielding plate is moving.

3. The paper sheet pickup device according to claim 1, further comprising a tank for retaining pressurized air on the second passage between an exhaust port of the pump and the second opening and closing device.

4. The paper sheet pickup device according to claim 1, further comprising a tank for retaining pressurized air on the second passage between an exhaust port of the pump and the second opening and closing device; and a filter device having an internal space and provided between a suction port of the pump and the first opening and closing device.

5. The paper sheet pickup device according to claim 1, further comprising a tank for retaining pressurized air provided on the second passage between the air feeding device and the second opening and closing device.

6. The paper sheet pickup device according to claim 1, further comprising a tank for retaining pressurized air provided on the second passage between the air feeding device and the second opening and closing device; and a filter device having an internal space and provided on the first passage between a suction port of the pump and the first opening and closing device.

* * * * *